US007516318B2

(12) United States Patent
Eun

(10) Patent No.: US 7,516,318 B2
(45) Date of Patent: Apr. 7, 2009

(54) METHOD OF CONTROLLING AN IMAGE FORMING APPARATUS

(75) Inventor: Jong-moon Eun, Suwon-si (KR)

(73) Assignee: Samsung Electronics Co., Ltd, Suwon-si (KR)

( * ) Notice: Subject to any disclaimer, the term of this patent is extended or adjusted under 35 U.S.C. 154(b) by 420 days.

(21) Appl. No.: 11/334,380

(22) Filed: Jan. 19, 2006

(65) Prior Publication Data

US 2006/0168437 A1 Jul. 27, 2006

(30) Foreign Application Priority Data

Jan. 21, 2005 (KR) ..... 10-2005-0005779

(51) Int. Cl.
*G03G 15/00* (2006.01)

(52) U.S. Cl. ..... 713/1; 713/2; 399/9; 399/12; 399/24; 399/25; 399/26; 399/27; 399/30; 347/7; 347/86

(58) Field of Classification Search ..... 713/1, 713/2; 399/9, 12, 24–27, 30; 347/7, 86
See application file for complete search history.

(56) References Cited

U.S. PATENT DOCUMENTS 5,807,005 A * 9/1998 Wright ..... 400/668
6,530,519 B1 * 3/2003 Suzuki ..... 235/375
7,177,553 B2 * 2/2007 Ono ..... 399/12
7,266,313 B2 * 9/2007 Yokoi et al. ..... 399/24

FOREIGN PATENT DOCUMENTS

| | | |
|---|---|---|
| EP | 0 854 044 | 7/1998 |
| JP | 10-324043 | 12/1998 |
| JP | 2002-251120 | 9/2002 |
| KR | 1999-13877 | 2/1999 |

* cited by examiner

*Primary Examiner*—Abdelmoniem Elamin
(74) *Attorney, Agent, or Firm*—Stanzione & Kim, LLP

(57) ABSTRACT

A method of controlling an image forming apparatus having at least one consumption part. The method includes fetching specification information corresponding to the at least one consumption part, detecting whether control information for controlling a printing operation of the image forming apparatus according to the specification information is present in a memory of the image forming apparatus, storing the specification information of the at least one consumption part and the control information about the printing operation into the memory of the image forming apparatus when the control information is not present in the memory, and controlling the printing operation of the image forming apparatus according to the control information stored in the memory of the image forming apparatus.

24 Claims, 8 Drawing Sheets

FIG. 3A

| NO | Main classification | Detail information classification | Note |
|---|---|---|---|
| 1 | Printer s printing speed | Input a printing speed by PPM | |
| 2 | Voltage to be applied to a development roller | First table for development Bias | Determined under considering a feature of a Toner, a development roller, a regulation blade, a supply roller |
| 3 | Voltage to be applied to a supply/withdrawal roller | First table for a supply voltage | |
| 4 | Voltage to be applied to a regulation blade | First table for a regulation blade | |
| 5 | Voltage to be applied to a charged body | First table for a charged supply voltage | To determine voltage to be applied under considering a printing speed, a charged body's resistor, and a responsive-to-light body |
| 6 | Control information of LSU's intensity of radiation | First table for a light power | Determined in association with a printing speed and a responsive-to-light body's sensitivity |
| 7 | Control information of a fixing temperature | First table for a fixing temperature | To determine a fixing temperature under considering a printing speed and Toner's information |
| 8 | Specification-recognition-information of consumption parts | Table for consumption parts => to define consumption parts with respect to a combination of main consumption parts | Information about consumption parts |

FIG. 3B

| Specification -recognition index of consumption parts | Development roller | Supply/ Withdrawal roller | Regulation Blade | Charged body | Photoconductive body | Toner | Note |
|---|---|---|---|---|---|---|---|
| 0001 | A | A | A | A | A | A | Reference |
| 0002 | A | A | A | A | A | B | Replacing a toner |
| 0003 | A | A | A | A | B | A | Replacing a photoconductive body |
| 0004 | A | A | A | B | A | A | Replacing a charged body |
| .... | ... | ... | ... | ... | ... | ... | ..... |
| .... | ... | ... | ... | ... | ... | ... | ..... |
| XXXX | B | B | B | B | B | B | |
| .... | ... | ... | ... | ... | ... | ... | ..... |
| .... | ... | ... | ... | ... | ... | ... | ..... |
| YYYY | D | E | F | G | H | I | |
| | | | | | | | |
| | | Reserved Memory Area | | | | | |

FIG. 3C

| NO | Main classification | Printing speed | Specification-recognition index of consumption parts | Development roller | Supply/ Withdrawal roller | Regulation Blade | Charged body | Photoconductive body | Toner | Applied value |
|---|---|---|---|---|---|---|---|---|---|---|
| 1 | First table for development Bias | 16 PPM | 0001 | A | A | A | A | A | A | -300 V |
| | | | 0002 | A | A | A | A | A | B | -320 V |
| | | | 0003 | A | A | A | A | B | A | -330 V |
| | | | ... | ... | ... | ... | ... | ... | ... | ... |
| | | | YYYY | D | E | F | G | H | I | -280 V |
| | | | | Reserved Memory Area | | | | | | |
| | | | | | | | | | | |
| 2 | First table for a supply voltage | 16 PPM | 0001 | A | A | A | A | A | A | -500 V |
| | | | ... | ... | ... | ... | ... | ... | ... | ... |
| | | | YYYY | D | E | F | G | H | I | -480 V |
| | | | | Reserved Memory Area | | | | | | |
| | | | | | | | | | | |
| 3 | First table for a regulation blade | 16 PPM | 0001 | A | A | A | A | A | A | -450 V |
| | | | ... | ... | ... | ... | ... | ... | ... | ... |
| | | | YYYY | D | E | F | G | H | I | -430 V |
| | | | | Reserved Memory Area | | | | | | |
| | | | | | | | | | | |
| 4 | First table for a charged supply voltage | 16 PPM | 0001 | A | A | A | A | A | A | -1.2 KV |
| | | | ... | ... | ... | ... | ... | ... | ... | ... |
| | | | YYYY | D | E | F | G | H | I | -1.4 KV |
| | | | | Reserved Memory Area | | | | | | |
| | | | | | | | | | | |

FIG. 3D

| Main classification | Printing speed | Specification-recognition index of consumption parts | Developmen roller | Supply/ Withdrawal roller | Regulation Blade | Charged body | Photoconductive body | Toner | Applied value |
|---|---|---|---|---|---|---|---|---|---|
| Laser Beam or light power of LED Print Head | 10 PPM | 0001 | A | A | A | A | A | A | 0.1 mW |
| | | 0002 | A | A | A | A | A | B | 0.1 mW |
| | | 0003 | A | A | A | A | B | A | 0.12 mW |
| | | ... | ... | ... | ... | ... | ... | ... | ... |
| | | YYYY | D | E | F | G | H | I | 0.15 mW |
| | | | Reserved Memory Area | | | | | | |
| | | | | | | | | | |
| | 15 PPM | 0001 | A | A | A | A | A | A | 0.15 mW |
| | | ... | ... | ... | ... | ... | ... | ... | ... |
| | | YYYY | D | E | F | G | H | I | 0.17 mW |
| | | | Reserved Memory Area | | | | | | |
| | | | | | | | | | |
| | 20 PPM | 0001 | A | A | A | A | A | A | 0.2 mW |
| | | ... | ... | ... | ... | ... | ... | ... | ... |
| | | YYYY | D | E | F | G | H | I | 0.22 mW |
| | | | Reserved Memory Area | | | | | | |
| | | | | | | | | | |
| | 30 PPM | 0001 | A | A | A | A | A | A | 0.3 mW |
| | | ... | ... | ... | ... | ... | ... | ... | ... |
| | | YYYY | D | E | F | G | H | I | 0.33 mW |
| | | | Reserved Memory Area | | | | | | |
| | | | | | | | | | |

FIG. 3E

| Main classification | Printing speed | Specification-recognition index of consumption parts | Development roller | Supply/Withdrawal roller | Regulation Blade | Charged body | Photoconductive body | Toner | Applied value |
|---|---|---|---|---|---|---|---|---|---|
| Fixing temperature | 10 PPM | 0001 | A | A | A | A | A | A | 140℃ |
| | | 0002 | A | A | A | A | A | B | 145℃ |
| | | 0003 | A | A | A | A | B | A | 140℃ |
| | | ... | ... | ... | ... | ... | ... | ... | ... |
| | | YYYY | D | E | F | G | H | I | 150℃ |
| | | | Reserved Memory Area | | | | | | |
| | | | | | | | | | |
| | 15 PPM | 0001 | A | A | A | A | A | A | 160℃ |
| | | ... | ... | ... | ... | ... | ... | ... | ... |
| | | YYYY | D | E | F | G | H | I | 165℃ |
| | | | Reserved Memory Area | | | | | | |
| | | | | | | | | | |
| | 20 PPM | 0001 | A | A | A | A | A | A | 170℃ |
| | | ... | ... | ... | ... | ... | ... | ... | ... |
| | | YYYY | D | E | F | G | H | I | 175℃ |
| | | | Reserved Memory Area | | | | | | |
| | | | | | | | | | |
| | 30 PPM | 0001 | A | A | A | A | A | A | 180℃ |
| | | ... | ... | ... | ... | ... | ... | ... | ... |
| | | YYYY | D | E | F | G | H | I | 185℃ |
| | | | Reserved Memory Area | | | | | | |
| | | | | | | | | | |

FIG. 4A

| NO | Main classification | Detail information classification | Note | |
|---|---|---|---|---|
| 1 | Specification information of a development roller | the quality of the lumber, resistor, hardness, the coefficient of friction, vendor's information, and etc | A | Specification-recognition index of consumption parts |
| 2 | Specification information of a supply/Withdrawal roller | the quality of the lumber, resistor, hardness, the number of Cell, vendor's information, and etc | A | |
| 3 | Specification information of a regulation blade | the quality of the lumber, first pressure, the field of freedom, vendor's information, and etc | A | |
| 4 | Specification information of a Photoconductive body | Sensitivity, Surface Energy, vendor's information, and etc | B | |
| 5 | Specification information of a Charged body | the quality of the lumber, resistor, hardness, the coefficient of friction, vendor's information, and etc | A | |
| 7 | Specification information of a Toner | Tg, Softening point, volume of electric charge, Diameter, vendor's information, and etc | A | |
| 8 | Specification-recognition index of consumption parts | ID number of consumption parts to be given with respect to a feature of the parts(system of index classification is equal to one of Table 2) | 0004 | Index |

FIG. 4B

| NO | Main classification | Detail information classification | Note |
|---|---|---|---|
| 1 | voltage to be applied to a development roller | Second table for development Bias | FIG. 3c |
| 2 | voltage to be applied to a supply/withdrawal roller | Second table for a supply voltage | |
| 3 | voltage to be applied to a regulation blade | Second table for a regulation blade | |
| 4 | voltage to be applied to a charged body | Second table for a charged supply voltage | |
| 5 | Control information of LSU's intensity of radiation | Second table for a light power | FIG. 3d |
| 6 | Control information of a fixing temperature | Second table for a fixing temperature | FIG. 3e |

METHOD OF CONTROLLING AN IMAGE FORMING APPARATUS

CROSS-REFERENCE TO RELATED APPLICATIONS

This application claims priority under 35 U.S.C. § 119 from Korean Patent Application No. 2005-5779 filed on Jan. 21, 2005 in the Korean Intellectual Property Office, the content of which is incorporated herein by reference in its entirety.

BACKGROUND OF THE INVENTION

1. Field of the Invention

The present general inventive concept relates to a method of controlling an image forming apparatus and, more particularly, to a method of controlling an image forming apparatus by automatically renewing control information according to replacement of consumption parts with new consumption parts.

2. Description of the Related Art

An image forming apparatus, such as a printer, a copier, and a facsimile machine, is generally designed such that various parts and/or units are assembled into a single case. Each of the parts and/or units can be individually and separately removed from the apparatus. For example, a printer that employs a type of electronic picture development is generally assembled to include various parts and/or units, such as a photoconductive drum, a toner cartridge, and a development roller, each of which can be individually and separately removed from the printer. When the parts and/or units in the printer are worn out, they can be replaced with new parts and/or units. Such parts and/or units are commonly referred to as "consumption parts," which are parts that can be individually and separately replaced with new parts in the image forming apparatus when they are worn out.

An image forming apparatus that includes consumption parts individually separatable therefrom contains specification information for each of the consumption parts and operates based on control information corresponding to such specification information currently stored in the apparatus. Accordingly, when a worn-out consumption part in an image forming apparatus is replaced with new consumption part, and a printing operation is performed base on the specification information of the old consumption part, it is difficult for the apparatus to provide a high quality image. In particular, specification information of the old consumption part and specification information of the new consumption part are not compatible and are different from each other.

The specification information of consumption parts may include, for example, the manufacturer's logo, the number of such parts used in an apparatus, and the date of manufacture, and may be stored in memories of the consumption parts. By updating the specification information of consumption parts used in an image forming apparatus, the life of each consumption part can be estimated in order to replace worn-out consumption parts with new consumption parts.

A manufacturer of an image forming apparatus may continually provide a user with many kinds of consumption parts so that a user can replace old consumption parts with new consumption parts, as needed.

Generally, life of an image forming apparatus reaches more than 10 years. However, during the use of consumption parts, their manufacture(s) can cease to exist for various reasons, such as a depressed market, a manufacture's intent, etc. Accordingly, it is not easy for a user to continually secure consumption parts that may be indispensable to operating the user's own image forming apparatus, or even parts compatible with such consumption parts. For example, a user who intends to continually use his apparatus for more than 10 years may incur an additional cost to secure sufficient stocks of consumption parts for an image forming apparatus in anticipation of a manufacturer ceasing to exist.

In addition, it is problematic for a manufacturer to manage consumption parts by classifying them according to the model(s) of a corresponding printer(s) for a multitude of venders of the parts, costing the manufacturer a great deal of expenses.

SUMMARY OF THE INVENTION

The present general inventive concept provides a method of controlling an image forming apparatus that provides a high quality image by automatically renewing control information of the image forming apparatus when replacing old consumption parts with new consumption parts based on specification information of the new consumption parts.

Additional aspects and advantages of the present general inventive concept will be set forth in part in the description which follows and, in part, will be obvious from the description, or may be learned by practice of the general inventive concept.

The foregoing and/or other aspects and utilities of the present general inventive concept are can be achieved by providing a method of controlling an image forming apparatus having at least one consumption part, the method including fetching specification information corresponding to the at least one consumption part from the at least one consumption part, detecting whether control information for controlling a printing operation of the image forming apparatus according to the specification information is present in a memory of the image forming apparatus, storing the specification information of the at least one consumption part and the control information corresponding to the specification information into the memory of the image forming apparatus when the control information is not present in the memory, and controlling the printing operation of the image forming apparatus according to the control information stored in the memory of the image forming apparatus.

After defining a specification-recognition-index of consumption parts containing a combination of the specification information for each consumption part in the image forming apparatus, the memory stores the specification information of the at least one consumption part in a table corresponding to the specification-recognition-index of consumption parts.

The memory may store control information to control a printing condition of the image forming apparatus as a table corresponding to the specification-recognition-index of consumption parts.

The printing condition may be a printing speed of the image forming apparatus.

The specification information of the at least one consumption part may include specification information about at least one of a development roller, a supply roller, a regulation blade, a charging roller, a photoconductive drum, and a toner.

The control information corresponding to the specification information of the at least one consumption part may include control information to control a voltage applied to at least one of a development roller, a supply roller, and a charging roller.

The control information corresponding to the specification information of the at least one consumption part may include control information to control a light power emitted from a luminous source of a scanning unit of the image forming apparatus.

The control information corresponding to the specification information of the at least one consumption part may include control information to control a fixing temperature of the image forming apparatus.

The method further include fetching specification information corresponding to the at least one consumption part and control information corresponding to the specification information from a sub memory of the at least one consumption part, detecting whether the sub memory control information corresponds to control information in a memory of the image forming apparatus by analyzing the fetched specification information, and controlling the printing operation of the image forming apparatus based on the memory control information when the sub memory control information corresponds to the memory control information without storing the sub memory control information in the memory of the image forming apparatus.

The memory may store the specification information and the control information fetched from the at least one consumption part as a list. The list may be located in a reserved area of the memory of the image forming apparatus, reserved to store the specification information and the control information fetched from the at least one consumption part.

The at least one consumption part may include a sub memory to store the specification information of the at least one consumption part and the control information corresponding to the specification information.

The at least one consumption part may include a sub memory to store control information to control one or more of a voltage, a fixing temperature of a fixing unit, and an intensity of radiation of a Laser Scanning Unit.

The method may further include fetching specification information corresponding to the at least one consumption part from a sub memory of the at least one consumption part, determining that a first control information for the at least one consumption part stored in a memory of the image forming apparatus does not correspond to the specification information, fetching a second control information corresponding to the specification information from the sub memory, renewing the memory by storing the second control information in the memory to replace the first control information, and controlling a printing operation of the image forming apparatus based on the second control information stored in the memory.

The foregoing and/or other aspects and utilities of the present general inventive concept are achieved by providing a method of controlling an image forming apparatus comprising at least one consumption part, the method including determining whether control information stored in a memory of the apparatus is corresponding control information, which corresponds to specification information of the at least one consumption part, or non-corresponding information, which does not correspond to the specification information, when the control information is determined to be non-corresponding control information, replacing the non-corresponding control information with corresponding control information, and controlling an operation of the image forming apparatus according to the corresponding control information stored in the memory.

The foregoing and/or other aspects and utilities of the present general inventive concept are achieved by providing a consumption part usable with an image forming apparatus, the consumption part including specification information specific to the consumption part, and control information corresponding to the consumption part to control an operation of the image forming device.

The consumption part may further include a sub memory to store the specification information and the control information. The control information may include information to control one or more of a voltage, a fixing temperature of a fixing unit, and a light power emitted from a luminous source of a scanning unit. The specification information may include specification information about at least one of a development roller, a supply roller, a regulation blade, a charging roller, a photoconductive drum, and a toner.

The foregoing and/or other aspects and utilities of the present general inventive concept are achieved by providing an image forming apparatus that includes the consumption part. The image forming apparatus may further include a memory and at least one of a development roller, a supply roller, a regulation blade, a charging roller, a photoconductive drum, and a toner.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which:

FIGS. 3A to 3E are diagrams illustrating a structure of data stored in the main memory of FIG. 2;

FIGS. 4A and 4B are diagrams illustrating a structure of data stored in the sub memory of FIG. 2.

DETAILED DESCRIPTION OF EMBODIMENTS

Figure 1:
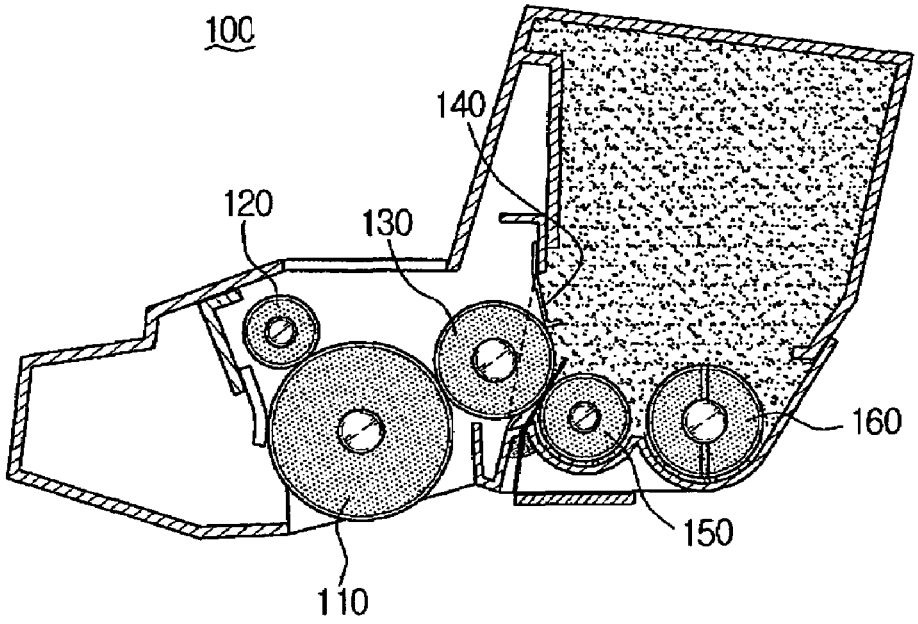
FIG. 1 is a schematic diagram illustrating a developer of an image forming apparatus according to an embodiment of the present general inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

In the following description, the same drawing reference numerals are used for the same elements in every drawing, including in different drawings. The matters defined in the description such as a detailed construction and elements are intended only to assist in a comprehensive understanding of the present general inventive concept. Thus, it is apparent that the present general inventive concept can be carried out without those defined matters. Also, well-known operations or constructions are not described in detail since they would obscure the present general inventive concept in unnecessary detail.

FIG. 1 is a schematic diagram illustrating a developer of an image forming apparatus according to an embodiment of the present general inventive concept.

Referring to FIG. 1, a developer 100 includes a photoconductive drum 110, a charging roller 120, a development roller 130, a regulation blade 140, and a supply roller 150.

The photoconductive drum 110, which may receive a toner supplied by the development roller 130, is configured to be either touchable or untouchable with respect to the development roller 130. The charging roller 120 is disposed at an inward place of the developer 100 in order to charge the photoconductive drum 110.

The development roller 130 is disposed at a place in close contact with the supply roller 150. The regulation blade 140 is disposed at an upper place on a surface of the development roller 130 in order to restrict a thickness of a toner's layer, applied on a surface of the development roller 130.

The supply roller 150 is disposed at a lower place in a toner chamber, near the bottom of the toner chamber, in which the supply roller 150 can rotate therein to apply a toner on a surface of the development roller 130 while in close proximity to the development roller 130. The agitator 160 is disposed in a toner chamber of the developer 100 in order to supply a toner to the supply roller 150.

Figure 2:
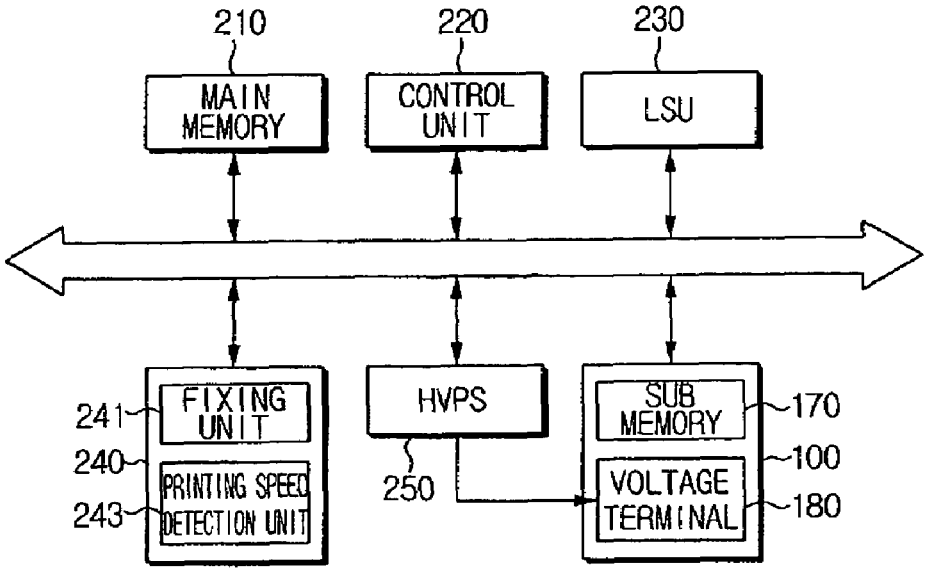
FIG. 2 is a schematic block diagram illustrating an image forming apparatus having the developer of FIG. 1.

FIG. 2 is a schematic block diagram illustrating an image forming apparatus having the developer of FIG. 1. Referring to FIG. 2, an image forming apparatus includes a main memory 210, a control unit 220, a LSU (Laser Scanning Unit) 230, a printing unit 240, a HVPS (High Voltage Power Supplier) 250, and a developer 100.

The main memory 210 includes a non-volatile memory (not shown) and a volatile memory (not shown). The non-volatile memory stores various kinds of data and programs to control an image forming apparatus, and the volatile memory stores various kinds of data produced during the performance of various operations of an image forming apparatus. In particular, the main memory 210 is to store various kinds of control information on an image forming apparatus according to specification information of consumption parts. Hereinafter, the above components shown in FIG. 2 will be described in detail.

The control unit 220 controls the overall operations of the image forming apparatus. In particular, the control unit 220 checks whether specification information is changed at a time of replacing consumption parts to detect whether control information corresponding to specification information has changed and to perform operations such as the renewal of control information. The control unit 220 thereby controls the image forming apparatus by generating control signals to optimally control each component of the image forming apparatus.

The LSU 230, which is a device exposed to a light, may be a laser diode, optical lens, a polygon mirror, a LD (Laser Disc) driver, and the like.

An image processing unit (not shown) performs an image processing of image data input from a computer or an image processing device. The image processing may be a shading and a gamma correction, a DPI transfer, an edge emphasis, a error diffusion, and the like.

The LSU 230 may be substituted with a LED print head using LED as a luminous source. The control unit 220 is configured to suitably control a certain value of a power of a luminous source emitted from the LSU 230 or LED print head to thereby obtain a high quality printing image. Accordingly, the control unit 220 controls the LSD 230 or a LED print head to hold a certain value of a luminous source according to control information stored at the main memory 210.

The printing unit 240, which includes a heating roller and a pressing roller, is configured to print out printing data on a paper. The heating roller and the pressing roller provide heat onto a printing paper on which a toner is transferred, and then the transferred toner adheres onto the paper. Thus, the transferred toner is melted by the heat simultaneously while pressing the paper.

Accordingly, the control unit 220 is configured to work in a manner such that a temperature of the heating roller is maintained at a certain temperature by controlling the heating source that applies the heat to the heating roller. The temperature of the heating roller may be measured by a thermistor that is disposed on a surface of the heating roller in order to detect the temperature of the heating roller.

The HVPS 250 is configured to produce a high voltage power and thereby to provide a suitable voltage to the developer. The HVPS 250 is also configured to provide a certain degree of voltage to the charging roller 120, the development roller 130, the regulation blade 140, and the supply roller 150 through a voltage terminal 180 disposed in the developer 100, under the control of the control unit 220.

The developer 100 additionally includes a sub memory 170 and a voltage terminal 180.

The sub memory 170 is configured to store information, such as, for examples, the identification of consumption parts, distribution information, life estimation information, and the like, in accordance with a model number of an image forming apparatus. The sub memory 170 is also configured to store specification information on each of the consumption parts assembled at an inward place of the developer 100 and to store control information of an image forming apparatus corresponding to the specification information.

In the execution of a printing job, the control unit 220 may control the HVPS 250 and the developer 100 to apply a suitable voltage to the charging roller 120, such that the charging roller 120 may make an outer surface around the photoconductive drum 110 charged uniformly, and may control the LSD 230 to create an electronic static image by transferring at least a portion of the charge on the surface of the photoconductive drum 150.

The control unit 220 may also control the HVPS 250 and the developer 100 to supply a suitable voltage to the supply roller 150, the regulation blade 140, and the development roller 130, respectively, such that a suitable thickness of a toner is transferred to the development roller 130.

The control unit 220 may also supply a suitable voltage to apply a toner adhesive to a surface of the photoconductive drum 110, on which an electronic static image is formed, to thereby develop an image. The control unit 220 then may transfer the toner-formed image onto a paper passing between the transfer roller (not shown) and the photoconductive drum 110.

When the paper onto which an image is transferred passes across the fixing unit 241, which includes the heating roller and the pressing roller, the control unit 220 may control the heat source of the fixing unit 241 to keep the heating roller at a certain temperature, and may enable the heating roller and the pressing roller to provide heat onto a paper. Thus the transferred toner may be melted on the paper and pressure may be applied, such that the transferred toner may be fixed on the paper.

FIGS. 3A to 3E are diagrams illustrating a structure of data stored in the main memory illustrated in FIG. 2.

FIG. 3A illustrates classification of control information and specification information of consumption parts stored in the main memory 210 of the image forming apparatus. FIG. 3A also illustrates a summary of detail control information about each component of the image forming apparatus and a recognition index of consumption parts illustrated in FIGS. 3B to 3E.

FIG. 3A illustrates classifying and making a listing of control information upon obtaining the control information regarding various printing speeds (PPM: Paper Per Minute) of the image forming apparatus. The listing of control information may include control information about such consumption parts as the development roller, the supply roller, the regulation blade, the charging roller, the scanning unit, and the fixing unit. The listing of control information is made as a table through which kinds of consumption parts are shown in order to identify specification-recognition-information with respect to each of the consumption parts.

The control information depends on the printing speed, which is one of the printing conditions. Although printing speed is used as an example of control information, the control information of the present general inventive concept is not limited to relating to the printing speed, and can thus relate to other operations of the image forming apparatus. The control information, with respect to all circumstances and conditions for printing, may be experimentally determined to make a listing thereof as a table, and such control information may be used to control the image forming apparatus.

FIG. 3B is a table illustrating a specification-recognition-index of consumption parts with respect to specification information of consumption parts to store in the main memory 210 according to kinds of consumption parts of the image forming apparatus.

Referring to FIG. 3B, upon combining specification information of consumption parts, such as the development roller, the supply roller, the regulation blade, the charging roller, the photoconductive drum, and the toner, a specification-recognition-index of consumption parts is defined on the basis of the combination of the specification information. Accordingly, when referring to a specification-recognition-index of consumption parts, the index may lead to the easy recognition t of the specification information associated with each of the consumption parts.

Accordingly, the main memory 210 may store specification information relating to at least one of the development roller, the supply roller, the regulation blade, the charging roller, the photoconductive drum, and the toner, and may store a table for a specification-recognition-index of consumption parts.

Referring to the recognition index table, a reserved memory area may be provided to add a new defined specification-recognition-index, which will be stored in the memory with predefined specification-recognition-indexes, into the table while taking into account the replacement of some consumption parts and the diversification of consumption parts.

FIG. 3C is a table for voltage control information illustrating a voltage value to be applied to the development roller, the supply roller, the regulation blade, and the charging roller, respectively, in order to control them on the basis of a specification-recognition-index of consumption parts stored in the main memory 210 of the image forming apparatus.

Referring to FIG. 3C, for example, when a printing speed is at 16 ppm, FIG. 3C illustrates a voltage value to be supplied to the development roller, the supply roller, the regulation blade, and the charging roller, with respect to a specification-recognition-index of consumption parts on the basis of specification information of such consumption parts, such as the development roller, the supply roller, the regulation blade, the charging roller, the photoconductive drum, and the toner.

Like the table for specification-recognition-index of consumption parts of FIG. 3B, in addition to the predefined specification-recognition-index thereof, the voltage control information table may have a reserved memory area to add a new defined specification-recognition-index into the table in order to accommodate various replacement consumption parts, which may be manufactured by various manufacturers.

FIG. 3D is a table for light power information illustrating a value to be respectively applied to the LSD or the LED print head on the basis of a specification-recognition-index of consumption parts stored in the main memory 210 of the image forming apparatus.

For example, when a printing speed is at 10, 15, 20, and 30 ppm (Print Per Minute), FIG. 3D illustrates an applied value of a light power emitted from a luminous source with respect to a specification-recognition-index for consumption parts on the basis of specification information of such consumption parts. Accordingly, the control unit 220 may control the scanning unit to keep a light power uniform on the basis of the control information illustrated in FIG. 3D.

Like the table for specification-recognition-index of consumption parts of FIG. 3B, in addition to the predefined specification-recognition-index thereof, the light power information table may have a reserved memory area to add a new defined specification-recognition-index into the table in order to accommodate various replacement consumption parts, which may be manufactured by various manufacturers.

FIG. 3E is table for control information of a fixing temperature, the table illustrating a fixing temperature at which the fixing unit may be controlled to heat the heating roller on the basis of a specification-recognition-index of consumption parts stored in the main memory 210 of the image forming apparatus.

For example, when an printing speed is at 10, 15, 20, and 30 ppm, FIG. 3E illustrates an applied value of a temperature emitted from a heating source, the temperature at which the heating roller may be heated, with respect to a specification-recognition-index of consumption parts corresponding to the specification information of such consumption parts. Accordingly, the control unit 220 may control a heating source of the fixing unit to keep a surface temperature of the heating roller at the applied temperature value based on the control information illustrated in FIG. 3E.

Like the table for specification-recognition-index of consumption parts of FIG. 3B, in addition to the predefined specification-recognition-index thereof, the control information table may have a reserved memory area to add new control information for a fixing temperature into the table a new specification-recognition-index of consumption parts is added FIGS. 4A and 4B illustrate a structure of data stored in the sub memory of FIG. 2, illustrating control information of the image forming apparatus corresponding to the specification information of the developer of FIG. 1.

As described above, the sub memory 170, provided at the developer, is configured to store information, such as the identification of consumption parts, distribution information, life estimation information, and the like, in accordance with a model number of the image forming apparatus. The sub memory 170 is also configured to store specification information of each of consumption parts assembled at an inward place of the developer 100 and control information of an image forming apparatus corresponding to the specification information.

Control information to be stored in the sub memory 170 may be defined depending on a specification-recognition-index of consumption parts stored in the main memory. However, the control information may be defined after first providing specification-recognition-information of consumption parts corresponding to specification information of such consumption parts. In the latter case, the control unit 220 detects a specification-recognition-index of consumption parts, stored in the main memory 210, from specification-recognition-information fetched in the sub memory 170, and then determines whether relevant control information exists in the main memory 210. Hereinafter, a detailed explanation of the above process will be described.

FIG. 4A is a specification recognition table of consumption parts to define the identification, such as a name, of consumption parts, a specification-recognition-index of consumption parts corresponding to the name of the consumption parts, and detail specification information thereof.

FIG. 4A is a table illustrating detail specification information of the consumption parts. In the table, identification information of consumption parts is listed and a specification-recognition-index of consumption parts is defined. The specification-recognition-index is determined on the basis of a combination of all of the consumption parts present in the image forming apparatus. The specification-recognition-index of consumption parts has the same system as the one stored in the main memory 210 illustrated in FIG. 3B. That is, both specification-recognition-index of consumption parts values should be equal, as illustrated in FIG. 3B and FIG. 4A (where both the specification-recognition-information of consumption parts shown in FIG. 4A and the one shown in FIG. 3B are equal).

FIG. 4B Illustrates control information about a fixing temperature of the fixing unit as well as control information about a developer, a supply roller, a regulation blade, a voltage to be applied to a charging roller, and a light power emitted from a luminous source of a scanning module in a scanning unit, in accordance with specification information of each of the consumption parts. A detailed description of the table of FIG. 4B will be omitted because the format and contents of the table of FIG. 4B is similar to each table shown on FIGS. 3C to 3E.

Figure 5:
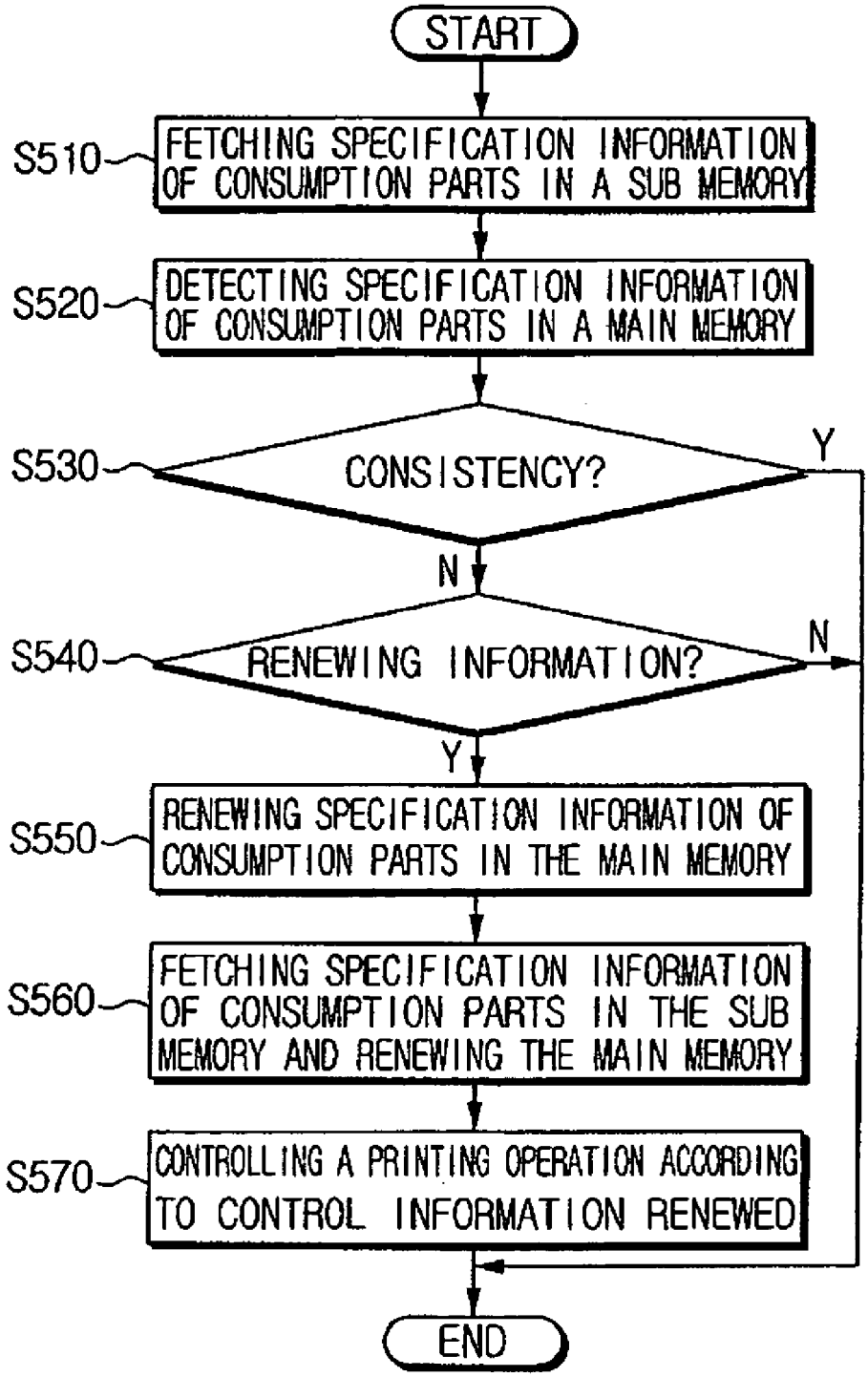
FIG. 5 is a flow chart illustrating control information of an image forming apparatus according to an embodiment of the present general inventive concept.

FIG. 5 is a flow chart illustrating control information of the image forming apparatus according to an embodiment of the present general inventive concept. First, when a power of an image forming apparatus is on, the control unit 220 serves to fetch specification-information of consumption parts from the sub memory 170 of the developer 100 (operation S510). Specification-information of consumption parts may come from a specification-recognition-index of consumption parts stored in the main memory 210. When specification information stored in the sub memory 170 does not include a specification-recognition-index of consumption parts, instead of the specification information it is possible to use detail parts information of each of the consumption parts, which are provided to the developer 100, and the identification of the consumption parts in accordance with the parts information thereof.

The control unit serves to detect an existence of a specification-recognition-index of consumption parts or equivalent specification information in a list of a table for a specification-recognition-index of the main memory 210, which corresponds to the specification information of consumption parts (operation S520). At this time, the control unit serves to determine whether a specification-recognition-index of consumption parts exists based on the specification-recognition-index or the specification information of the operation S520. That is, when a specification-recognition-index of consumption parts is stored in the sub memory 170, the control unit detects whether an index equivalent to it is present in the sub memory 170. Alternatively, when a specification-recognition-index of consumption parts is not stored in the sub memory 170, the control unit is to detect whether a list corresponding to a combination of consumption parts is present in the table for a specification-recognition-index of consumption parts in the main memory 210 (operation S530).

When specification information of consumption parts is stored in the sub memory according to a corresponding list in a table for a specification-recognition-index of consumption parts stored in the main memory 210, the control unit 220 controls an image forming apparatus by a control signal appropriate to the corresponding specification-recognition-index stored in the main memory 210. Alternatively, when specification information of consumption parts is not stored in the sub memory acording to a corresponding list in a table for a specification-recognition-index of consumption parts stored in the main memory 210, a corresponding control signal does not exist in the main memory 210 such that an appropriate control signal should be fetched from the sub memory 170.

The control unit 220 may also determine whether an input specification-recognition-information of consumption parts is correct, or whether the consumption parts are real or fake, to prevent a quality of printing results from being poor and to prevent an image forming apparatus from malfunctioning (operation S540).

Accordingly, before new control information (based on which a printing operation of an image forming apparatus may be controlled) is fetched from consumption parts and stored in the memory of the image forming apparatus to renew its control information, it is necessary to determine whether the new control information is necessary after recognizing certain coded information among the specification information of consumption parts. This is necessary to prevent poor image quality and to keep an image forming apparatus from operating under wrong control information, which may result in the malfunctioning of the image forming apparatus. In particular, the step of renewing the memory's control information is not performed when it is determined that the memory's control information corresponds to the specification information of the consumable part.

In a renewal of control information of the main memory 210, the control unit 220 serves to additionally give a specification-recognition-index of consumption parts for the specification information of consumption parts fetched from the sub memory. The specification information of consumption parts, which belongs to a table for a specification-recognition-index of consumption parts stored in the main memory 210, is renewed by adding specification information of consumption parts and a specification-recognition-index to the table (operation S550).

The control unit 220 also serves to fetch control information of an image forming apparatus corresponding to specification information of the consumption parts stored in the sub memory 170. The control unit 220 also serves to renew control information of the main memory 210 by appropriately adding the control information of an image forming apparatus, fetched from the sub memory 170, corresponding to the value of the specification-recognition-index of consumption parts, renewed already in the former process, to a table for control information stored in the main memory 210 (operation S560).

Accordingly, the control unit 220 serves to control each component of an image forming apparatus on the basis of the specification-recognition-index of consumption parts with respect to the developer 100 so that the apparatus may perform sequential processes of print operations to obtain a high quality image for a printout, by using the renewed control information of the main memory 210 (operation S570).

As described above, it is advantageous to obtain a high quality image by controlling an image forming apparatus on the basis of specification information of the consumption parts present in the image forming apparatus, specifically when replacing old consumption parts with new ones, by automatically renewing control information of an image forming apparatus with respect to specification information of replaced consumption parts.

Furthermore, while the image forming apparatus continues to be used during it's life, and old consumption parts are replaced with new ones that have inconsistent specification information, a high quality image for a printout can be obtained by alternatively providing optimal control information corresponding to the specification information of the new replacement parts. Furthermore, the image forming apparatus may be used under harsh operating conditions even though new consumption parts may not be available in the future. In addition, a user can reduce costs by not having to maintain stocks of consumption parts.

In particular, since consumption parts may be controlled according to a printing speed, it is advantageous to enable current stocks of consumption parts to be compatible with a new image forming apparatus, such as a printer and a copier with a feature of more enhanced printing speed then is currently available. Accordingly, a manufacture can reduce costs by using replacement consumption parts in the new apparatus that include a feature for a more enhanced printing speed, and for a user to obtain such consumption parts.

It is also advantageous to ensure a supply of consumption parts and to save on costs associated with the management of stocks of consumption parts, because it is not necessary to individually manage various consumption parts based on the model of an image forming apparatus.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A method of controlling an image forming apparatus having at least one consumption part, the method comprising:

fetching specification information corresponding to the at least one consumption part from the at least one consumption part;

detecting whether control information to control a printing operation of the image forming apparatus according to the specification information is present in a memory of the image forming apparatus;

storing the specification information of the at least one consumption part and the control information corresponding to the specification information into the memory of the image forming apparatus when the control information is not present in the memory; and controlling the printing operation of the image forming apparatus according to the control information stored in the memory of the image forming apparatus.

2. The method of claim 1, wherein after defining a specification-recognition-index of consumption parts containing a combination of the specification information for each consumption part in the image forming apparatus, the memory stores the specification information of the at least one consumption part in a table corresponding to the specification-recognition-index of consumption parts.

3. The method of claim 2, wherein the memory stores control information to control a printing condition of the image forming apparatus as a table corresponding to the specification-recognition-index of consumption parts.

4. The method of claim 3, wherein the printing condition comprises a printing speed of the image forming apparatus.

5. The method of claim 3, wherein the specification information of the at least one consumption part comprises specification information about at least one of a development roller, a supply roller, a regulation blade, a charging roller, a photoconductive drum, and a toner.

6. The method of claim 1, wherein the control information corresponding to the specification information of the at least one consumption part comprises control information to control a voltage applied to at least one of a development roller, a supply roller, and a charging roller.

7. The method of claim 1, wherein the control information corresponding to the specification information of the at least one consumption part comprises control information to control a light power emitted from a luminous source of a scanning unit of the image forming apparatus.

8. The method of claim 1, wherein the control information corresponding to the specification information of the at least one consumption part comprises control information to control a fixing temperature of the image forming apparatus.

9. The method of claim 1, further comprising:

fetching specification information corresponding to the at least one consumption part and control information corresponding to the specification information from a sub memory of the at least one consumption part;

detecting whether the sub memory control information corresponds to control information in a memory of the image forming apparatus by analyzing the fetched specification information; and controlling the printing operation of the image forming apparatus based on the memory control information when the sub memory control information corresponds to the memory control information without storing the sub memory control information in the memory of the image forming apparatus.

10. The method of claim 1, wherein the memory stores the specification information and the control information fetched from the at least one consumption part as a list.

11. The method of claim 10, wherein the list is located in a reserved area of the memory of the image forming apparatus, reserved to store the specification information and the control information fetched from the at least one consumption part.

12. The method of claim 1, wherein the at least one consumption part comprises a sub memory to store the specification information of the at least one consumption part and the control information corresponding to the specification information.

13. The method of claim 1, wherein the at least one consumption part comprises:

a sub memory to store control information to control one or more of a voltage;

a fixing temperature of a fixing unit; and an intensity of radiation of a Laser Scanning Unit.

14. The method of claim 1, further comprising:

fetching specification information corresponding to the at least one consumption part from a sub memory of the at least one consumption part;

determining that a first control information for the at least one consumption part stored in a memory of the image forming apparatus does not correspond to the specification information;

fetching a second control information corresponding to the specification information from the sub memory;

renewing the memory by storing the second control information in the memory to replace the first control information; and controlling a printing operation of the image forming apparatus based on the second control information stored in the memory.

15. A method of controlling an image forming apparatus comprising at least one consumption part, the method comprising:

determining whether control information stored in a memory of the apparatus is corresponding control information, which corresponds to specification information of the at least one consumption part, or non-corresponding information, which does not correspond to the specification information;

when the control information is determined to be non-corresponding control information, replacing the non-corresponding control information with corresponding control information; and controlling an operation of the image forming apparatus according to the corresponding control information stored in the memory.

16. A consumption part usable with an image forming apparatus, the consumption part comprising:

specification information specific to the consumption part; and control information corresponding to the consumption part to control an operation of the image forming device, such that the control information is compared with pre-stored control information stored within the image forming apparatus and then is stored within the image forming apparatus if the control information does not match the pre-stored control information.

17. The consumption part of claim 16, further comprising:

a sub memory to store the specification information and the control information.

18. The consumption part of claim 16, wherein the control information comprises:

information to control one or more of a voltage;

a fixing temperature of a fixing unit; and a light power emitted from a luminous source of a scanning unit.

19. An image forming apparatus, comprising:

a consumption part, comprising a sub memory to store specification information corresponding to the consumption part, and control information corresponding to the specification information of the consumption Part to control a printing operation of the image forming apparatus;

a main memory to store the specification information corresponding to the consumption part and the control information corresponding to the specification information when the control information is not present in the main memory; and a control unit to compare the specification information stored in the sub memory of the consumption part with specification information stored in the main memory to determine whether the control information corresponding to the specification information of the consumption part is present in the main memory of the image forming apparatus, and to control the printing operation of the image forming apparatus according to the corresponding control information stored in the main memory of the image forming apparatus.

20. The image forming apparatus of claim 19, further comprising a at least one of a development roller, a supply roller, a regulation blade, a charging roller, a photoconductive drum, and a toner.

21. An image forming apparatus, comprising:

a consumption part including specification information corresponding to the consumption part, and control information corresponding to the specification information to control a printing operation of the image forming device;

a main memory to store the specification information and the control information corresponding to the specification information when the corresponding control information is not present in the main memory; and a control unit to control the printing operation of the image forming apparatus according to the corresponding control information stored in the main memory of the image forming apparatus.

22. The image forming apparatus of claim 21, further comprising:

at least one of a laser scanning unit (LSU) and an LED print head to emit an image-forming light from a luminous source, such that the control unit controls the LSU or the LED print head to hold a certain value of the luminous source according to the corresponding control information stored in the main memory of the image forming apparatus.

23. The image forming apparatus of claim 21, further comprising:

a high voltage power supplier (HVPS) to provide a voltage to the consumption part, such that the control unit controls the level of the voltage according to the corresponding control information stored in the main memory of the image forming apparatus.

24. The image forming apparatus of claim 23, further comprising:

a photoconductive drum to receive a toner; and a charging roller to charge the photoconductive drum, such that the control unit controls the HVPS to apply a voltage to the charging roller to provide a uniform charge to the photoconductive drum.

* * * * *